US006235345B1

(12) United States Patent
Williamson et al.

(10) Patent No.: US 6,235,345 B1
(45) Date of Patent: May 22, 2001

(54) LABEL ADHESIVE APPLICATION ASSEMBLY

(75) Inventors: Jimmy D. Williamson; Jimmy D. Williamson, Jr., both of Turlock, CA (US)

(73) Assignee: Gerro Plast GmbH, Dusseldorf (DE)

( * ) Notice: Subject to any disclaimer, the term of this patent is extended or adjusted under 35 U.S.C. 154(b) by 0 days.

(21) Appl. No.: 09/301,955

(22) Filed: Apr. 29, 1999

Related U.S. Application Data

(63) Continuation-in-part of application No. 09/024,886, filed on Feb. 17, 1998, now Pat. No. 6,045,616.

(60) Provisional application No. 60/039,555, filed on Feb. 25, 1997, provisional application No. 60/040,544, filed on Mar. 12, 1997, and provisional application No. 60/046,699, filed on May 14, 1997.

(51) Int. Cl.[7] ..... B05D 1/02; B05B 15/04

(52) U.S. Cl. ..... 427/282; 427/208.2; 427/208.4; 427/208.6; 427/288; 427/290; 427/294; 427/422; 427/424; 118/301; 118/324; 118/319; 118/40; 156/521; 156/529; 156/568

(58) Field of Search ..... 427/208.2, 208.4, 427/208.6, 282, 288, 290, 294, 422, 424; 118/301, 324, 319, 40; 156/521, 529, 568

(56) References Cited

U.S. PATENT DOCUMENTS

| | | | |
|---|---|---|---|
| 3,027,870 | 4/1962 | Schirmer | 118/504 |
| 3,048,146 | 8/1962 | Coppola | 118/301 |
| 3,088,859 | 5/1963 | Smith | 264/518 |
| 3,295,491 | 1/1967 | Cassarno | 118/681 |
| 3,322,095 | 5/1967 | Gelbjerg-Hansen et al. | 118/682 |
| 3,422,793 | 1/1969 | Lachmann | 118/301 |
| 3,635,194 | 1/1972 | Prior | 118/301 |
| 3,963,557 | 6/1976 | Patterson | 156/519 |
| 4,188,843 | 2/1980 | Dickey | 83/304 |
| 4,210,481 | 7/1980 | Wolff et al. | 156/357 |
| 4,269,874 | 5/1981 | Pryor et al. | 427/282 |
| 4,332,635 | 6/1982 | Holbrook et al. | 156/256 |
| 4,338,155 | 7/1982 | Buchele | 156/539 |
| 4,354,887 | 10/1982 | Total | 156/64 |
| 4,369,214 | 1/1983 | Pfulb et al. | 427/428 |
| 4,544,431 | 10/1985 | King | 156/256 |
| 4,589,943 | 5/1986 | Kimball et al. | 156/256 |
| 4,595,449 | 6/1986 | Nowicki | 156/444 |
| 4,629,528 | 12/1986 | Tanaka et al. | 156/351 |
| 4,632,721 | 12/1986 | Hoffman et al. | 156/458 |
| 4,642,150 | 2/1987 | Stemmler | 156/164 |
| 4,671,843 | 6/1987 | Olsen | 156/450 |
| 4,687,535 | 8/1987 | Voltmer | 156/361 |
| 4,708,630 | 11/1987 | Hammond | 425/504 |
| 4,761,200 | 8/1988 | Szeremeta | 156/448 |

(List continued on next page.)

FOREIGN PATENT DOCUMENTS

| | | |
|---|---|---|
| 19544763 A1 | 6/1997 | (DE) . |
| 1446880 | 9/1965 | (FR) . |
| 94/15842 | 7/1994 | (WO) . |
| 98/17537 | 5/1998 | (WO) . |
| 98/19916 | 5/1998 | (WO) . |
| 98/36974 | 8/1998 | (WO) . |

OTHER PUBLICATIONS

Walter C. Larsem, A study in machine development, Modern Packaging (Mar. 1960), pp. 201–207.

*Primary Examiner*—Linda L. Gray
(74) *Attorney, Agent, or Firm*—Emch, Schaffer, Schaub & Porcello, Co, L.P.A.

(57) ABSTRACT

An improved adhesive application assembly (70) for a labeling machine (2) includes an adhesive sprayer (76) which directs heated adhesive (88) towards labels (60) passing the adhesive application station (70). A moving heated adhesive shield (80) includes one or more windows (84), through which the adhesive is sprayed, surrounded by a heated overspray-intercepting surface (90). The intercepted adhesive is collected for reuse.

9 Claims, 8 Drawing Sheets

U.S. PATENT DOCUMENTS

| | | | |
|---|---|---|---|
| 4,844,760 | 7/1989 | Dickey | 156/215 |
| 4,904,324 | 2/1990 | Heider | 156/214 |
| 4,978,415 | 12/1990 | Jones | 156/517 |
| 5,024,717 | 6/1991 | Winter | 156/354 |
| 5,032,344 | 7/1991 | Kaminski | 264/509 |
| 5,079,057 | 1/1992 | Heider | 428/36.5 |
| 5,116,452 | 5/1992 | Eder | 156/566 |
| 5,160,570 | 11/1992 | Dickey | 156/448 |
| 5,194,299 * | 3/1993 | Fry | 427/208.6 |
| 5,254,302 | 10/1993 | Yamanaka | 264/129 |
| 5,259,910 | 11/1993 | Biagiotto | 156/456 |
| 5,266,149 | 11/1993 | Collette et al. | 156/571 |
| 5,356,508 | 10/1994 | Watanabe | 156/566 |
| 5,405,667 | 4/1995 | Heider | 428/36.5 |
| 5,431,763 | 7/1995 | Bradshaw | 156/256 |
| 5,618,347 | 4/1997 | Clare et al. | 118/314 |

* cited by examiner

LABEL ADHESIVE APPLICATION ASSEMBLY

CROSS-REFERENCE TO RELATED APPLICATIONS

This application is a continuation-in-part of U.S. patent application Ser. No. 09/024,886, filed Feb. 17, 1998, now U.S. Pat. No. 6,045,616, titled "Adhesive Station and Labeling Machine", which claims the benefit of the following Provisional Patent Applications: application Ser. No. 60/039,555, filed Feb. 25, 1997, titled "Labeling Machine"; application Ser. No. 60/040,544, filed Mar. 12, 1997, titled "Labeling Machine with Label Transport Turret"; and application Ser. No. 60/046,699, filed May 14, 1997, titled "Labeling Machine and Method". The disclosure of each is incorporated by reference.

BACKGROUND OF THE INVENTION

Labeling machines are used to apply labels to all types of containers, both cylindrical containers and non-cylindrical containers, such as regular and irregular shaped polygons. One type of conventional label is a self-stick label, also called a pressure-sensitive label, which is carried by a backing strip. Self-stick labels are expensive and create a large amount of waste. Self-stick labels typically used with high-density polyethylene (HDPE) containers, such as milk jugs and juice bottles, are commonly a paper/propylene/adhesive laminate. When such self-stick labels are applied to conventional HDPE containers, the label must be cut out, often by hand, before the container can be recycled. Therefore, a tremendous amount of waste is created by the use of conventional laminated, self-stick labels on the estimated eight to ten billion one-gallon and half-gallon HDPE containers used in the U.S. annually.

Another type of commonly used labels is cut from continuous label material wound onto a roll. Labels made from continuous label material are more economical than self-stick labels and are often made from thin, stretchable film. To reduce the cost, the film keeps being made thinner. This stretchiness can make it difficult to ensure that the labels are properly cut.

Conventional labeling machines remove the continuous label material from the roll and feed the label material to a cutting system. The continuous label material is then cut into labels which are transferred face down onto the circumferential surface of a vacuum drum where they are held in place by vacuum. As the drum rotates the labels pass a glue roller which applies adhesive to the back (outer) surface of the label, typically at its leading and trailing edges. The label, with the adhesive applied thereto, is released from the drum as it comes into contact with and is applied to a container.

SUMMARY OF THE INVENTION

The present invention provides an efficient and cost-effective method for applying adhesive to labels.

A label adhesive application assembly includes an adhesive sprayer which directs heated adhesive towards labels passing along the label path. A movable heated adhesive shield is used to control the spray of the heated adhesive to the proper region of the label. The adhesive shield includes a moving window, through which the adhesive is sprayed, surrounded by a heated overspray-intercepting surface. The intercepted adhesive is collected by the surface and drains into an adhesive collector for recycling.

The label adhesive station can be used with different types of labeling machines. For example, one type passes a continuous length of label material along the outer surface of a label supporting and cutting assembly. The outer surface preferably has a number of slots through which blades pass to cut the length of label material into cut labels. Another type of labeling machine cuts the label from continuous label material using a rotary anvil, around which the label material passes, and a rotary die registered with the rotary anvil. The rotary die has a blade which cuts the label material resting on the rotary anvil. The waste material surrounding the die-cut label is then removed and preferably recycled.

A primary advantage of the invention is that it is especially useful for running rolls of uncut label material made of polystyrene and/or polyethylene and/or other plastic material. The invention is especially useful for applying shaped labels, typically made of polystyrene, polypropylene or other plastic materials, to rectangular HDPE containers used in the dairy and allied industries. With the invention the cost of labels can be reduced and the ease of recycling is greatly enhanced. Other recyclable label material can also be used. The costs of using the present invention are expected to be reduced by about 30 to 50 percent over the cost of self-stick labels conventionally used with HDPE containers.

Other features and advantages of the invention will appear from the following description in which the preferred embodiments have been set forth in detail in conjunction with the accompanying drawings.

DESCRIPTION OF THE SPECIFIC EMBODIMENTS

Figure 1:
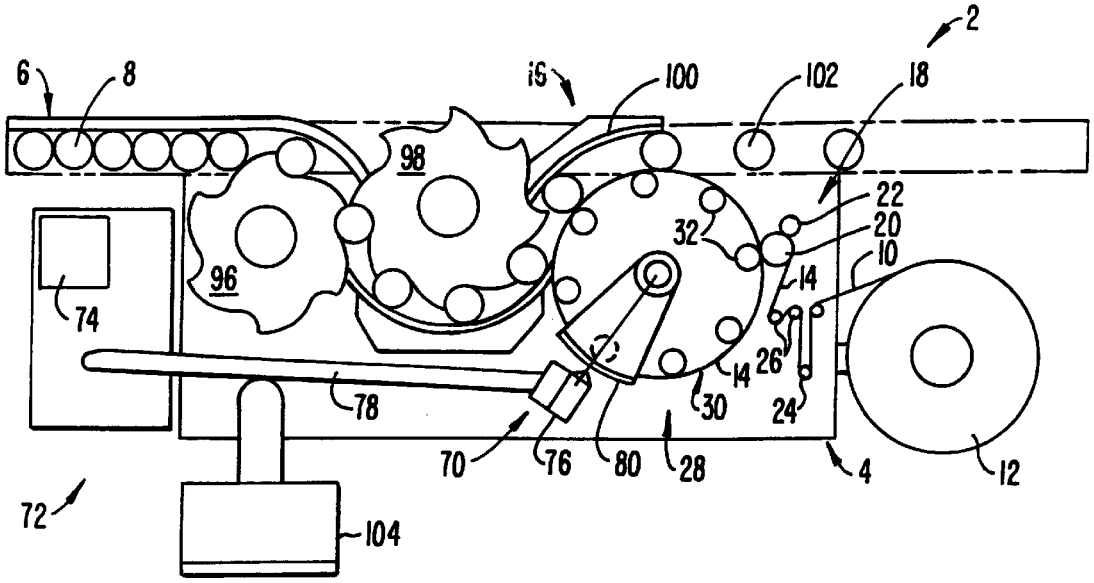
FIG. 1 is a somewhat simplified plan view of a first embodiment of a labeling machine made according to the invention.
Figure 2:
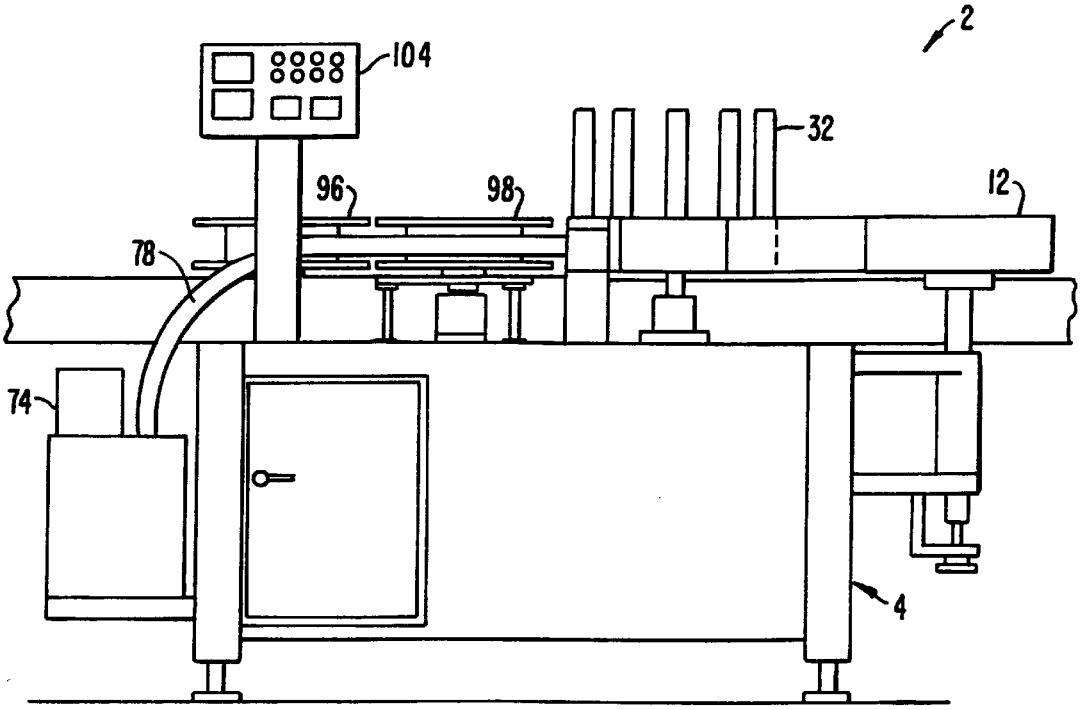
FIG. 2 is a front elevational view of the labeling machine of FIG. 1.

FIGS. 1 and 2 illustrate a labeling machine 2 made according to certain aspects of the present invention. Labeling machine 2 includes a stand 4 to which the various components are mounted. Labeling machine 2 is used adjacent to a conveyor 6 along which various containers 8 to be labeled are driven. Label material 10 is supplied as a continuous length of material from a label material roll 12 supported by stand 4. Label material 10 passes along a label path 14 from roll 12 to a label application station 16 as is discussed in more detail below.

The initial portion of label path 14 is defined by a label material feed assembly 18. Label material feed assembly is generally conventional and includes a driven label feed roller 20 which drives label material 10 between the roller and pinch roller 22. Label material feed assembly 18 also includes a label tensioning roller 24 and several idler rollers 26 to ensure the proper tension is maintained on label material 10.

Figure 3:
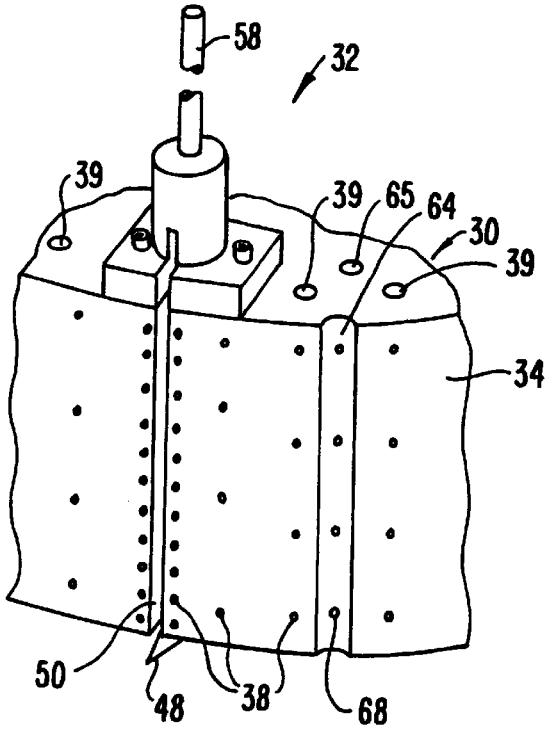
FIG. 3 illustrates a portion of the rotary cutting drum of FIG. 1 showing a blade assembly and label shifting groove together with air holes positioned along the label supporting surface and within the label shifting groove.
Figure 4:
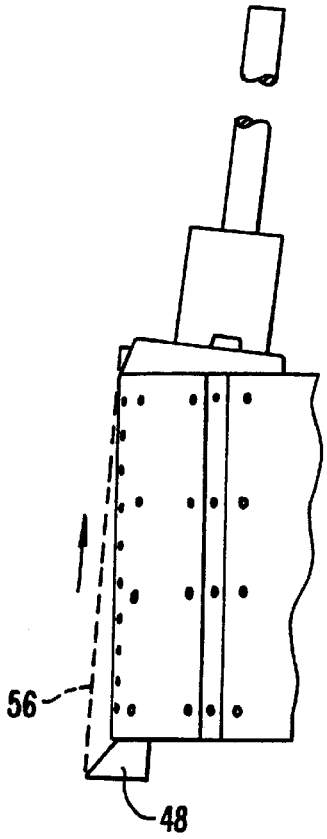
FIG. 4 is a side view of the apparatus of FIG. 3 illustrating the path of the tip of the blade.
Figure 5:
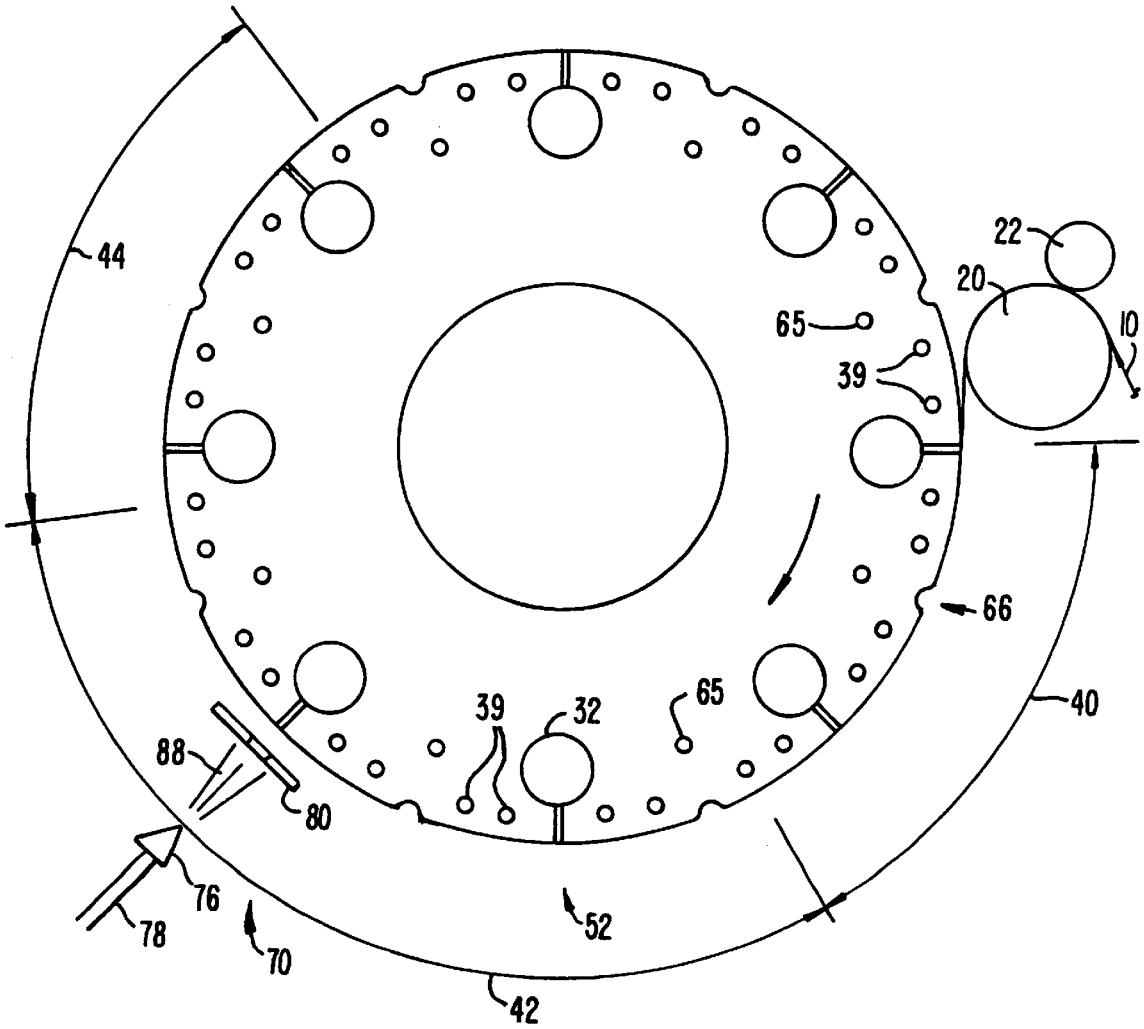
FIG. 5 is a schematic top plan view identifying the rotary regions at which the air holes in the rotating label supporting surface of FIGS. 3 and 4 are supplied with vacuum, to secure label material to the surface, and with pressurized air, to help dislodge the cut label from the surface as the label is adhered to the container.

Label material 10 advances to a label supporting and cutting assembly 28. Assembly 28 includes a rotating drum 30. In the preferred embodiment there are eight equally spaced blade assemblies 32 positioned at the periphery of drum 30, that is adjacent to the label supporting surface 34 of drum 30. See also FIGS. 3–5. Situated between each blade assembly 32 is a label shifting groove 64 formed in label supporting surface 34. Label material 10 is adhered to label supporting surface 34 through the use of various air holes 38 formed in surface 34. Air holes 38 are coupled, through correspondingly located air ports 39, to a vacuum source, a pressurized air source or neither depending upon the rotary orientation of drum 30. Each air port 39 typically supplies air or vacuum to one, two, or three columns of air holes 38. As shown in FIG. 5, a vacuum is applied to air holes 38 over rotary regions 40 and 42 while air holes 38 are connected to a pressurized air source over rotary region 44 and neither a vacuum nor a pressurized air source over the remainder rotary region. The application of this vacuum over rotary regions 40, 42 adheres label material 10 to surface 34. The vacuum applied over region 40 is less than that applied over region 42 to accommodate proper registration of label material 10 on surface 34, discussed below.

Figure 6:
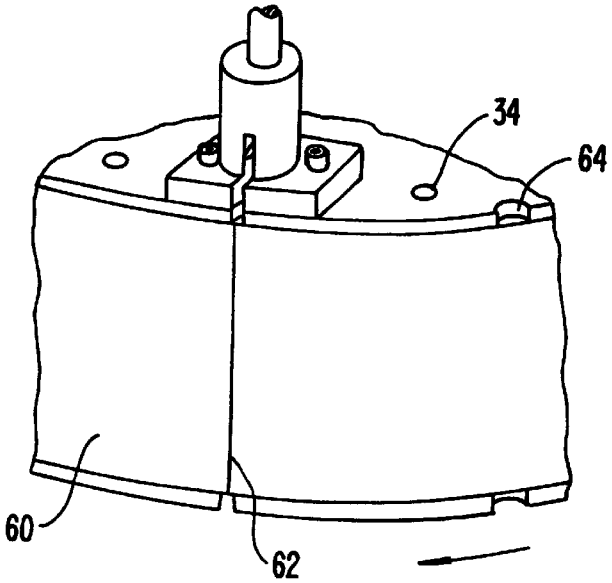
FIG. 6 is similar to FIG. 3 but with label material adhered to the label supporting surface and with the blade at the upper end of its stroke creating a cut label.

Each blade assembly 32 includes a reciprocating blade 48 which passes through a blade slot 50 formed in label supporting surface 34. Each blade is driven along blade slot 50 when that blade assembly 32 reaches a cutting position 52 shown in FIG. 5. Blade 48 is driven upwardly so that the tip of blade 48 passes along an angled path 56 by a pneumatic blade reciprocator 58. The result of this movement is shown in FIG. 6 which illustrates a cut label 60 to the left and the next label to be cut to the right with their opposed, newly cut edges 62 abutting one another.

Because nothing is ever perfect, cut label 60 from label material 10 will, sooner or later, stop being registered, that is properly centered, between each blade slot 50. Registration of label material 10 is achieved in a simple manner. Each blade slot 50 is positioned so that the distance between adjacent blade slots is slightly smaller, such as 0.005 inch (0.13 mm) smaller than the nominal width of each label. This means that the off-center positioning of the labels will only be in one direction. When it is determined, typically using conventional optical sensing of registration marks along the edge of a label, that the labels have been shifted by a predetermined amount, such as 0.1 inch (0.25 mm), then a vacuum is applied to air holes 68 in a label shifting groove 64 through an air port 65 when groove 64 is at a position 66; position 66 is adjacent where label material 10 first contacts surface 34. Doing so pulls a little extra label material 10 into groove 64. This application of a vacuum to air holes 68 formed in label shifting groove 64 at position 66 typically occurs for two or three successive label shifting grooves to shift the label a predetermined amount, such as 0.2 inch (0.5 mm). Positioning shifting position 66 close to where label material 10 first contacts surface 34 of drum 30 helps to prevent the stretching of the label material which could otherwise occur.

Cut labels 60 then proceed to an adhesive station 70. An adhesive application assembly 72 includes a hot melt unit 74, see FIGS. 1 and 2, coupled to a heated adhesive sprayer 76 by a line 78. Assembly 72 also includes a heated adhesive shield 80, see FIGS. 1, 5, 7 and 7A, which is mounted for oscillatory movement about the center 81 of drum 30 by support arm 82. Shield 80 includes a window 84.

Figure 7:
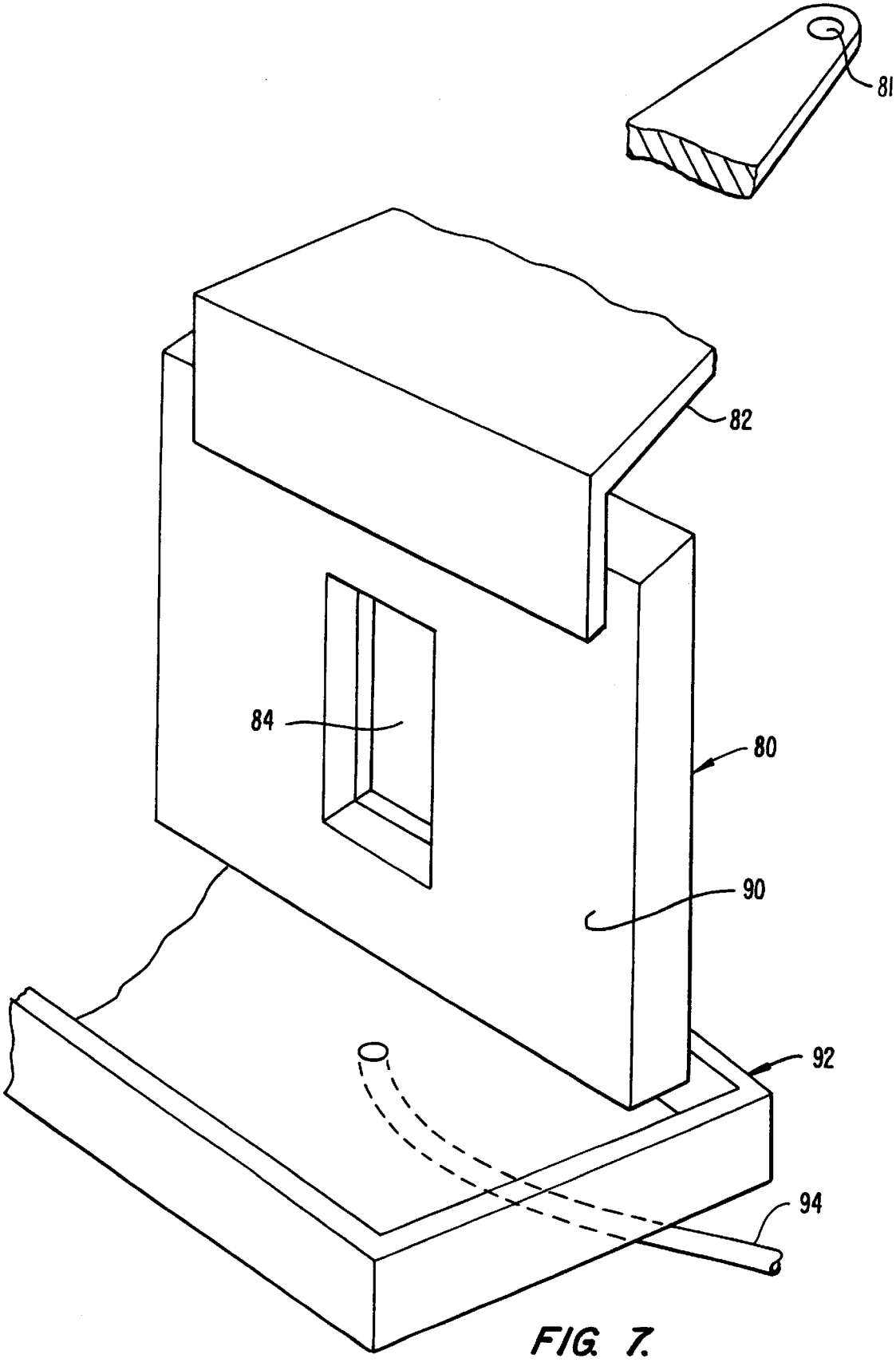
FIG. 7 is a simplified overall view of an adhesive shield and an adhesive collector of FIG. 1.
Figure 7A:
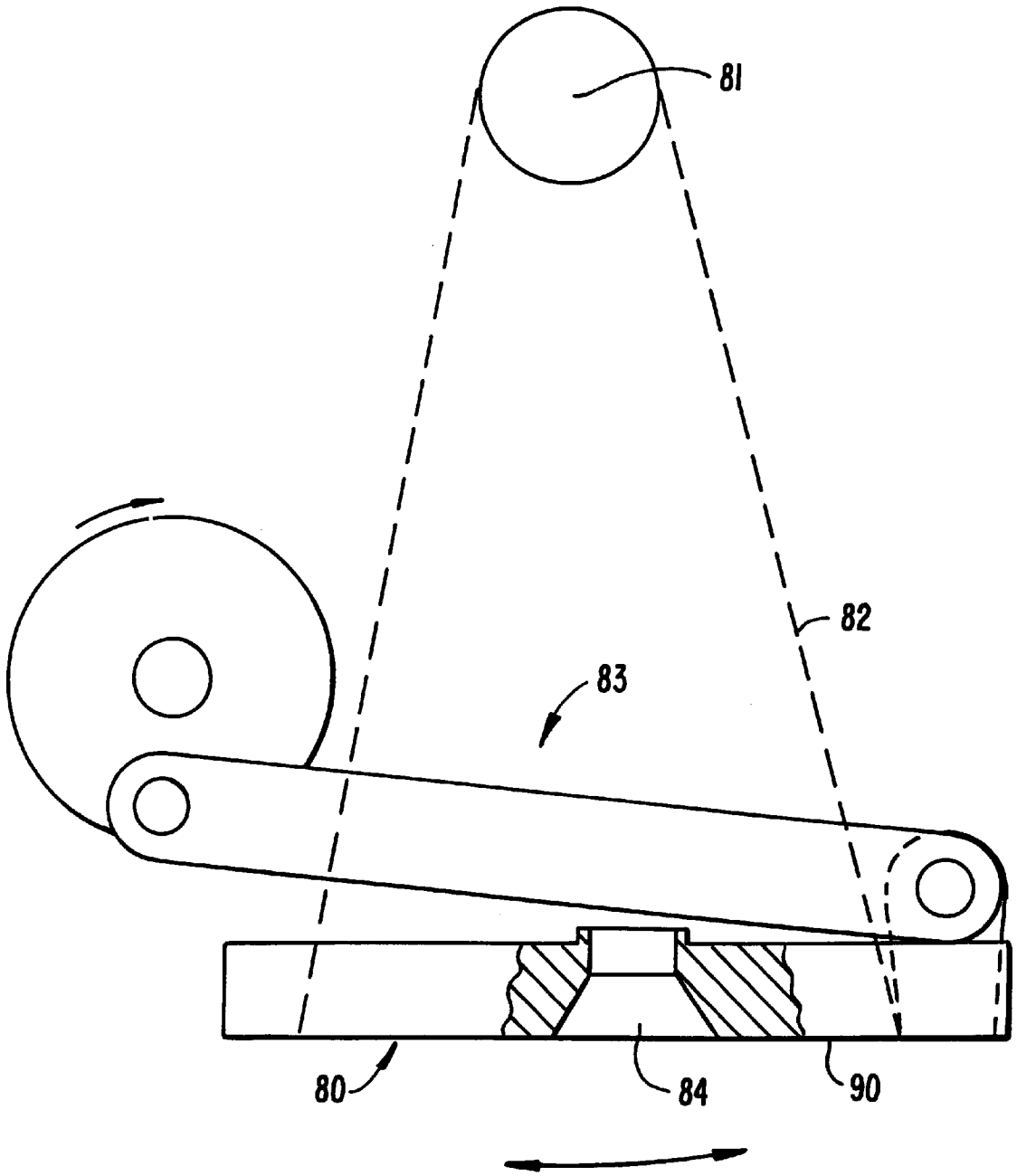
FIG. 7A is a partially schematic illustration showing a crank arm assembly used to oscillate the adhesive shield of FIG. 7.

During operation drum 30 rotates in a clockwise direction in FIGS. 1 and 5 so that as a cut label 60 approaches adhesive station 70, shield 80 pivots in a counterclockwise direction a short distance, such as 2 inches (5 cm), using a crank arm assembly 83 (shown only in FIG. 7A). The timing of the oscillation of shield 80 is chosen so that once blade slot 50, and thus opposed cut edges 62 of labels 60 are centered on window 84, adhesive shield 80 is pivoted in a clockwise direction at generally the same rate of speed as drum 30.

It has been found that certain adhesives tend to string between adjacent labels. Therefore, in some situations it may be necessary to use a thin divider, such as a vertical divider (not shown) bisecting window 84. Using a divider helps shield opposed cut edges 62 from heated adhesive 88 sprayed from sprayer 76 as shown in FIG. 5. For example, for a label 60 having a width of 9.375 inches (23.8 cm) and a height of 4 inches (10 cm), window 84 has a width of 1 inch (2.5 cm) and a height of 3.875 inches (9.8 cm); a vertically-extending divider 0.25 inch (0.63 cm) wide is centered within window 84. Window 84 is sized to provide a strip of adhesive adjacent to cut edges 62. However, divider 86 helps prevent a buildup of adhesive at cut edges 62. The need for divider may be eliminated depending on the characteristics of the particular adhesive used. Also, the need to oscillate adhesive shield 80 may be unnecessary depending on the circumstances. However, at higher rates of speed, an oscillating heat shield is often desired for proper adhesive application.

Adhesive shield 80 includes a heated surface 90 surrounding window 84 which intercepts adhesive overspray. Surface 90 is heated to the temperature of adhesive 88 to keep it flowable. Adhesive 88 which does not pass through window 84 but contacts surface 90 is directed down surface 90 into a heated adhesive collector 92. Adhesive collector 92 is coupled to hot melt unit 74 by a line 94 so that collected overspray adhesive can be recycled so that the overspray is not wasted.

Cut labels 60, with adhesive 88 applied thereto, are then applied to containers 8 at label application station 16. Label application station 16 is generally conventional and includes an infeed star 96 which removes containers 8 one at a time from conveyor 6 and transfers these containers to a transfer star wheel 98 which passes the containers to a roll-down pad 100. The containers are captured between roll-down pad 100 and cut label 60 so that the container rolls along the surface of roll-down pad 100 and cut label 60. Label 60, with an adhesive applied thereto, is applied to container 8 in a conventional manner. Labeled containers 102 then exit from label application station 16 and continue along conveyor 6.

In use, label material 10 moves along label path 14, that is through feed assembly 18 and onto vacuum surface 34 of drum 30. The vacuum applied to air holes 38 along rotary regions 40, 42 pulls label material 10 against surface 34. Any label material registration is accomplished by providing vacuum to air holes 68 at label shifting grooves 64. Label material 10 is cut into cut labels 60 at cutting position 52 by blades 48. Adhesive 88 is sprayed onto the trailing edge of one label and the leading edge of the adjacent label 60 using adhesive application assembly 72. Cut label 60, now with adhesive 88 applied along the leading and trailing cut edges 62, are then applied to containers 8 at label application station 16. Labeled containers 102 are then discharged into conveyor 6. The various operations of machine 2 are controlled in a conventional manner by a commercial controller, such as that made by EMP of New York, using a control panel 104.

Figure 8:
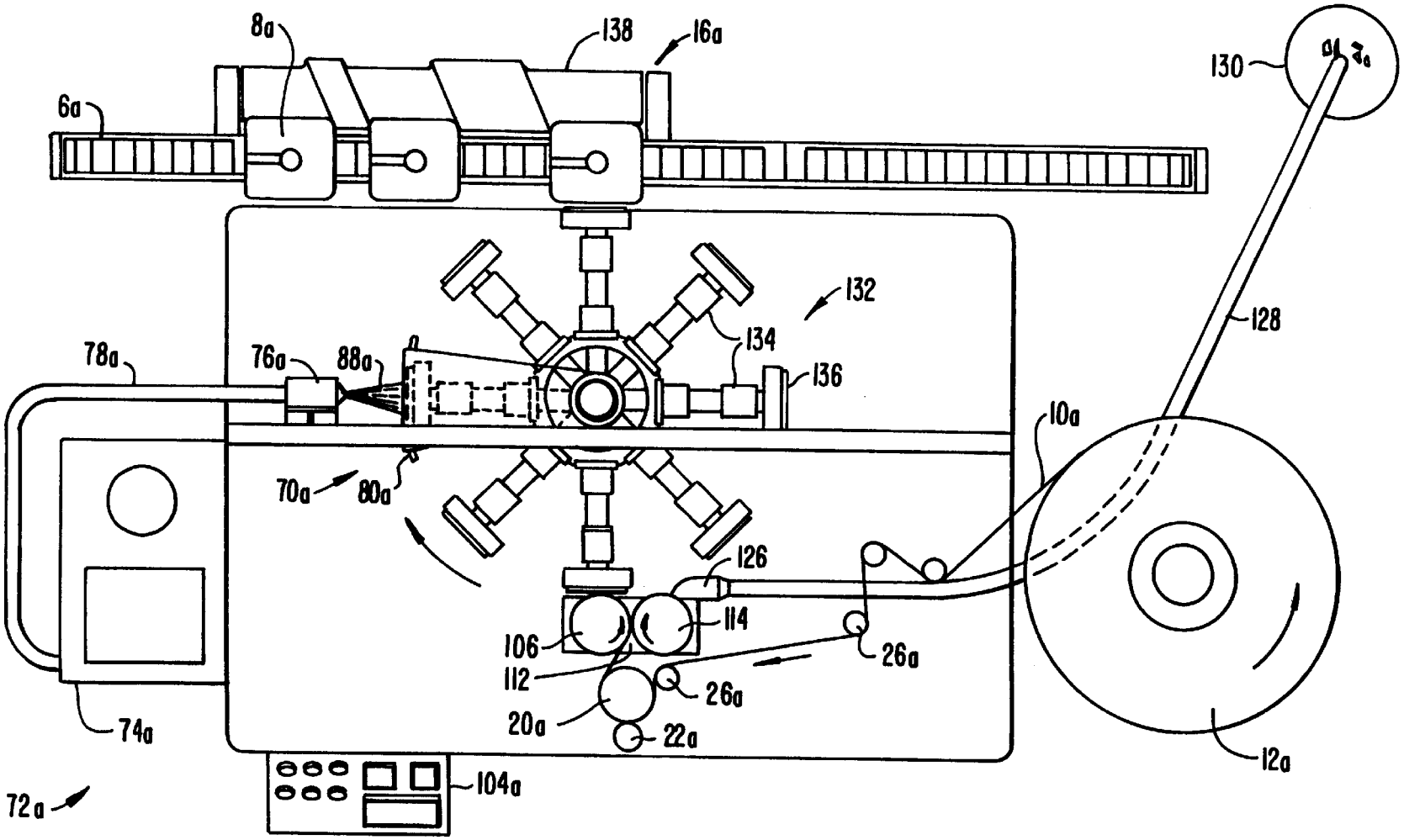
FIG. 8 is a simplified plan view of a second embodiment of a labeling machine made according to the invention.
Figure 9:
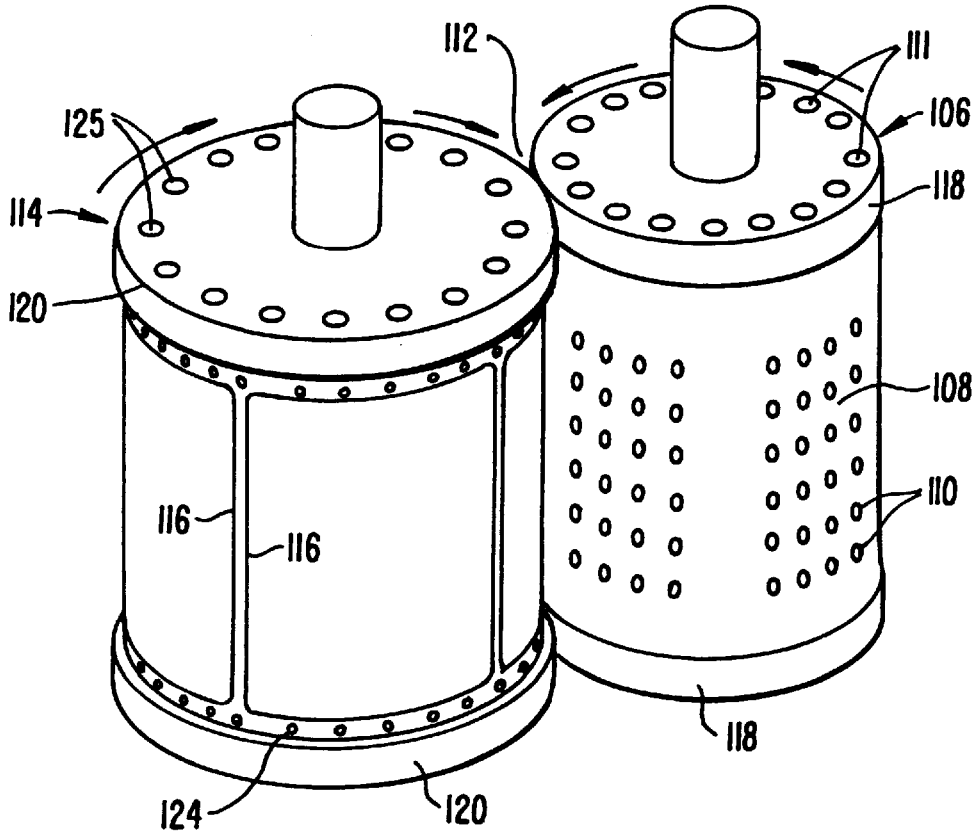
FIG. 9 is an enlarged view of the rotary anvil roller and rotary die cutter roller of FIG. 8.

FIG. 8 illustrates a labeling machine 106 which uses an adhesive application assembly 72*a,* similar to assembly 72 of FIGS. 1–7, with like elements referred to by like reference numerals. In the preferred embodiment label material 10*a* is a material compatible with and suitable for recycling with HDPE containers 8*a,* such as polystyrene. Label material 10*a* passes idler rollers 26*a,* between label feed roller 20*a* and pinch roller 22*a,* and into contact with a rotary anvil roller 106, shown best in FIG. 9. Rotary anvil roller 106 has a generally smooth outer surface 108 but with numerous air holes 110 formed therein. Air holes 110 are connected to a vacuum source, a pressurized air source or neither through air ports 111 in roller 106 according to the rotary orientation of roller 106. After contacting surface 108 of roller 106, label material 10*a* passes into a nip 112 created between roller 106 and a rotary die cutter roller 114. Rotary die cutter roller 114 has a number of relatively short, radially outwardly extending circumferential knife blades 116 each outlining the circumference of a label to be cut from label material 10*a*. In the preferred embodiment knife blades 116 are about 0.0625 inch (1.6 mm) high. The proper spacing between rollers 106, 114 is maintained by positioning rollers 106, 118 so that their respective annular end surfaces 118, 120 touch.

Figure 10:
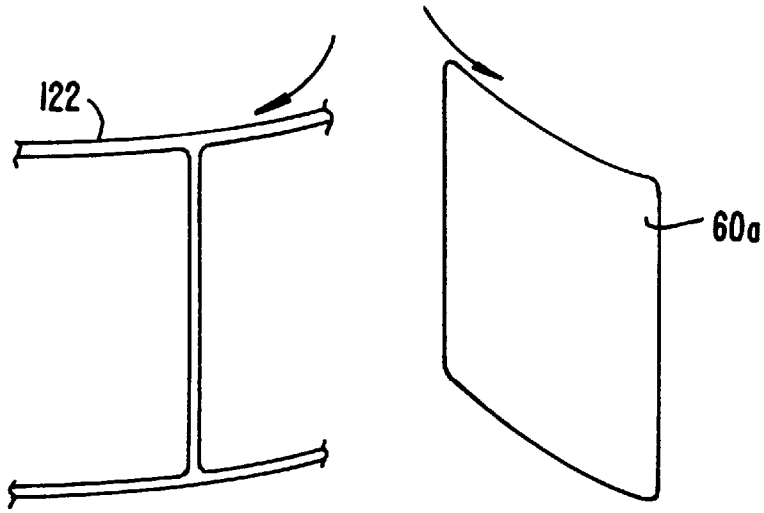
FIG. 10 illustrates a cut label and label scrap created by the rollers of FIG. 9.

Passing label material 10*a* between rollers 106, 114 creates cut labels 60*a* and label scrap 122 as suggested in FIG. 10. Cut label 60*a* remains adhered to surface 108 of roller 106 by virtue of the vacuum applied to holes 110. Only when cut label 60*a* has reached a position opposite where the label is to be transferred to a label transfer surface 136 described below is the vacuum applied to holes 110 released; at that point a pressurized air supply is coupled to holes 110 through corresponding ports 111 to help direct cut label 60*a* towards the label transfer surface.

To effectively remove label scrap 122, roller 114 has air holes 124 formed in its surface in the region surrounding knife blades 116. Vacuum, pressurized air or neither is provided to air holes 124 through corresponding ports 125 in roller 114. The provision of vacuum to air holes 124 causes label scrap 122 to be pulled away from cut label 60*a* and roller 106 and be temporarily adhered to roller 114. The vacuum applied to holes 124 is released and the holes are then connected to a pressurized air source to help release label scrap 122 into the inlet 126 of a vacuum line 128 connected to a vacuum scrap recovery container 130.

Cut labels 60 are released from anvil roller 106 to a label transfer turret 132. Label transfer turret 132 has, in this embodiment, eight radially-extending arms 134. Each arm 134 has a label transfer surface 136 having perforations which are fluidly coupled to a vacuum source, a source of pressurized air or neither according to the rotary position of surface 136. Each surface 136 has a radius of curvature with the center at the center of turret 132. Cut labels 60*a* are transferred from roller 106 to arcuate surface 136 as surface 136 passes adjacent surface 108 of roller 106. During this time pressurized air is applied to holes 110 which are covered by the particular cut label 60*a* to be transferred while the holes in surface 136 are connected to a vacuum to cause cut labels 68 to adhere to transfer surface 136.

When a label 60*a* mounted to label transfer surface 136 reaches adhesive station 70*a,* heated adhesive 88*a* is sprayed through a window in heated adhesive shield 80*a*. If the entire surface is to have adhesive 88*a* applied to it, the window in heated adhesive shield 80*a* is generally the same size as cut label 60*a*. Alternatively, the window in shield 80*a* could be smaller to apply adhesive to particular regions of cut labels 60*a,* such as the leading and trailing edges. For simply-shaped labels, such as that shown in FIG. 10*a* as cut label 60*a,* shield 80*a* can generally be stationary. However, for other shapes or for different types of adhesive application patterns it may be desired or necessary to have shield 80*a* oscillate to achieve the desired adhesive pattern.

Label 60*a,* with adhesive 88*a* applied thereto, is then applied to container 8*a* as the container passes label application station 16*a*. As surface 136 passes label application station 16*a* the holes in the surface may be temporarily connected to a source of pressurized air so to dislodge any label which may have, for whatever reason, not been transferred from surface 136.

In use, label material 10*a* is unrolled from label material roll 12*a* by label feed roller 20*a* and directed onto surface 108 of anvil roller 106. Label material 10*a* on surface 108 is then engaged by knife blades 116 carried by rotary die cutter roller 114 to cut out individual labels 60*a*. Label scrap 122 is collected into a vacuum scrap recoveryb container 130 and labels 60*a* are transferred to surfaces 136 of the passing arms 134 of turret 132. Adhesive 88*a* is then applied to cut labels 60*a* by adhesive application assembly 72*a*. A label 60*a,* with adhesive 88*a* applied thereto, is then adhered to the surface of a container 8*a* at station 16*a*. Containers 8*a* are properly driven along label application station 16*a* by a feed screw 138. The now-labeled container then continues down conveyor 6*a*.

Figure 11:
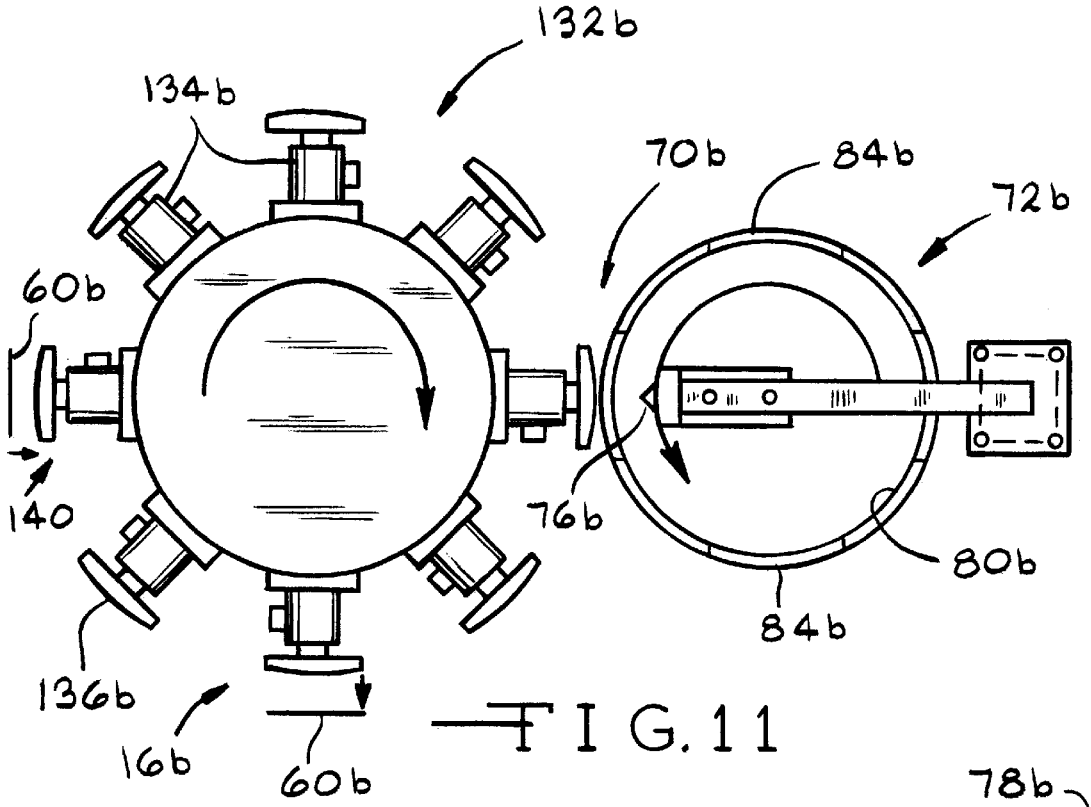
FIGS. 11 and 12 are simplified plan and side views of a third embodiment of an adhesive station made according to the invention.
Figure 12:
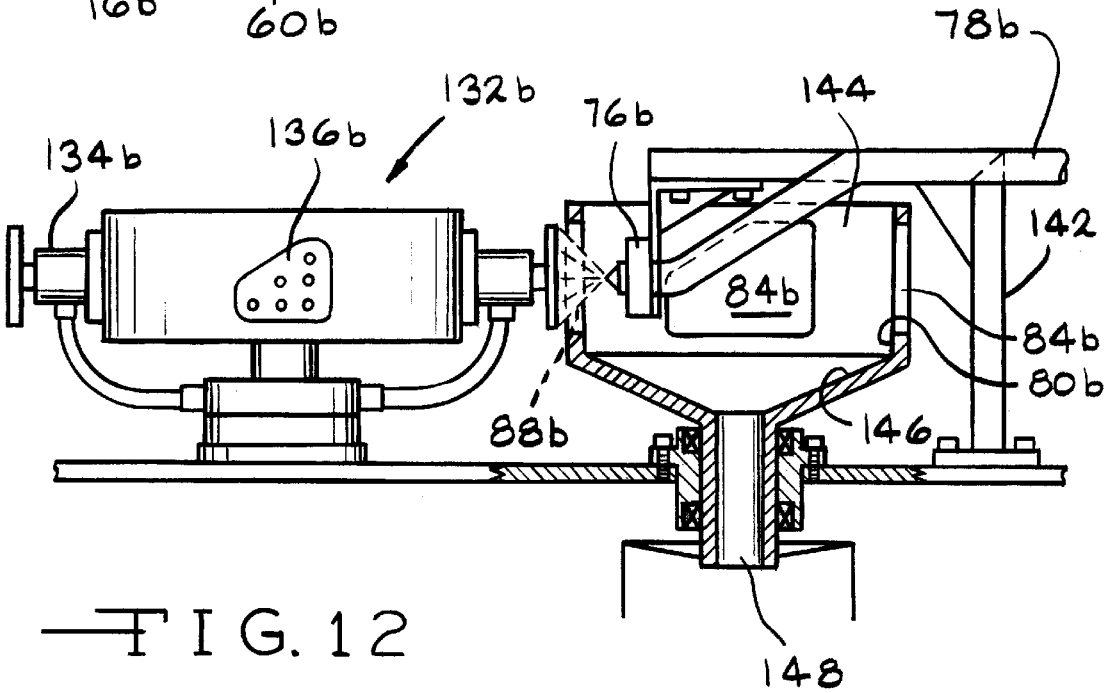

FIGS. 11 and 12 illustrate an adhesive application assembly 72*b* and a label transfer turret 132*b* similar to the embodiments of FIGS. 1 and 8 with like elements referred to by like reference numerals. Label transfer turret 132*b* has a number, in this embodiment eight, radially outwardly extending arms 134*b*. Each arm 134*b* has a label transfer surface 136*b* having numerous perforations coupled to a vacuum source, a source of pressurized air or neither according to the rotational position of surfaces 136*b*. Cut labels 60*b* are transferred to surfaces 136*b* in an appropriate manner, such as that illustrated in FIG. 8. Adhesive application assembly 72*b* includes a rotating, heated shield 80*b* having four windows 84*b* formed therein. As arms 134*b* reach adhesive application station 70*b,* adhesive 88*b* is applied to label 60*b* by sprayer 76*b* spraying adhesive through a window 84*b*. Windows 84*b* are sized and shaped according to the size and shape of label 60*b* and the desired adhesive spray pattern.

Rotating heated shield 80*b* thus acts a continuously moving, heated adhesive shield. The rotation of shield 80*b* is timed to accurately match the movement and position of each label 60*b* carried at the end of each arm 134*b* as label 60*b* reaches adhesive application station 70*b*. By the accurate registration of windows 84*b* with label 60*b* as well as the appropriate sizing of the window, permits adhesive 88*b* to be applied very accurately, including to the edge of the labels, without any appreciable overspray escaping from adhesive shield 80*b* resulting in a higher quality label. The label with adhesive applied thereto is applied to the container at label application station 16*b*. A vacuum is applied to surfaces 136*b* from a label pick-up station 140 until just before label application station 16*b*. Upon reaching label application station 16*b*, positive air pressure as applied to the holes in surface 136*b* to help transfer label 60*b* from its arm 134*b* to the container. The transfer to the container can be done in a number of ways, including that shown in FIG. 8. From station 16*b* to just before station 140, neither pressurized air nor partial vacuum is applied to surface 136*b*.

FIG. 12 illustrates the shape of one surface 136*b* having 5 sides. The shape of surface 136*b* can, but need not, correspond to the shape of the label 60*b*. FIG. 12 also shows how sprayer 76*b* is supported at a stationary position within rotating adhesive shield 80*b* by an L shaped support 142. Oversprayed adhesive is collected by the heated inner surface 144 of rotating, heated adhesive shield 80*b* where it flows downwardly onto conical surface 146 and through central discharge opening 148 for collection and reuse. As suggested in FIG. 12, the shape of windows 84*b* may correspond generally to the shape of label transfer surface 136*b* and of label 60*b*.

Other modifications and variations can be made to the disclosed embodiments without departing from the subject invention as defined in the following claims. For example, collector 92 could be incorporated into shield 80. Labels may be transferred to the adhesive application station by other than a turret, such as by a moving belt or a rotary drum. The labels can be of any number of different regular or irregular shapes. The moving heated shield could be replaced by other types of moving heated shields, such as a moving belt or rotary disk having one or more windows.

What is claimed is:

1. A method for applying adhesive to a label comprising the following steps:

moving a label past an adhesive station along a label path;

moving an adhesive shield, comprising a moving window surrounded by a heated overspray-intercepting surface, between a heated adhesive sprayer and the label path;

spraying heated adhesive through the moving window and onto the label by the adhesive sprayer;

intercepting adhesive overspray by the heated overspray-intercepting surface; and collecting said adhesive overspray from the adhesive shield.

2. The method according to claim 1 wherein said label moving step comprises the step of continuously moving the label past the adhesive station.

3. The method according to claim 1 further comprising the steps of:

removing a length of label material from a source of label material; and forming a series of labels from the length of label material.

4. The method according to claim 1 wherein said adhesive shield encircles said heated adhesive sprayer and said step of spraying comprises spraying said heated adhesive outwardly through said moving window.

5. The method according to claim 3 wherein the removing step is carried out using a roll of label material as the source of label material.

6. The method according to claim 3 wherein the forming step is carried out using a rotary die cutter element and an opposed rotary anvil.

7. The method according to claim 6 further comprising the step of removing scrap label material following the forming step.

8. The method according to claim 6 wherein the scrap material removing step comprises the step of temporarily applying a vacuum to portions of said rotary die cutter element so to pull said scrap label material away from said labels.

9. The method according to claim 3 wherein the forming step is carried out by directing said label material against a label material-supporting surface and moving a blade along said label material-supporting surface so to cut said label material into labels.

* * * * *